United States Patent [19]

Mimura et al.

[11] Patent Number: 4,537,845

[45] Date of Patent: Aug. 27, 1985

[54] MULTICONDUCTIVE LAYER ELECTROPHOTOGRAPHIC PHOTOSENSITIVE DEVICE AND METHOD OF MANUFACTURE THEREOF

[75] Inventors: Yoshiyuki Mimura; Takao Okada; Akitoshi Toda, all of Hachioji, Japan

[73] Assignee: Olympus Optical Company Ltd., Japan

[21] Appl. No.: 543,385

[22] Filed: Oct. 19, 1983

[30] Foreign Application Priority Data

Oct. 20, 1982 [JP] Japan ..... 57-184189

[51] Int. Cl.[3] ..... G03G 5/14

[52] U.S. Cl. ..... 430/58; 430/63; 430/67; 430/85; 430/131; 430/69

[58] Field of Search ..... 43/58, 69, 84, 67, 63, 43/131

[56] References Cited

U.S. PATENT DOCUMENTS

| | | | |
|---|---|---|---|
| 3,679,418 | 7/1972 | Stroszynski et al. | 430/69 |
| 4,081,273 | 3/1978 | Goffe | 430/69 |
| 4,134,763 | 1/1979 | Fujimura et al. | 430/66 |

FOREIGN PATENT DOCUMENTS 2055269 7/1982 Fed. Rep. of Germany .

*Primary Examiner*—John Goodrow

*Attorney, Agent, or Firm*—Ostrolenk, Faber, Gerb & Soffen

[57] ABSTRACT

In an electrophotographic photosensitive device including a conductive layer, a selenium based photoconductive layer and a transparent insulating layer which are sequentially laminated, the conductive layer is formed by an aluminum substrate conductive layer, a zinc conductive layer (or a zinc conductive layer and a copper conductive layer), and a nickel conductive layer which are sequentially laminated to each other. As a result of this structure, the charge injection characteristic during the primary charging step is improved, and the charge injection preventing characteristic during the simultaneous secondary charging and image exposure steps is sufficiently maintained. The conductive layers contact each other intimately. The electrophotographic photosensitive device exhibits a high humidity durability and a long life and can obtain high electrostatic contrast.

10 Claims, 2 Drawing Figures

MULTICONDUCTIVE LAYER ELECTROPHOTOGRAPHIC PHOTOSENSITIVE DEVICE AND METHOD OF MANUFACTURE THEREOF

BACKGROUND OF THE INVENTION

The present invention relates to an electrophotographic photosensitive device essentially composed of a conductive layer, a photoconductive layer and a transparent insulating layer for an electropohotographic copying machine, and to a method of manufacture thereof.

For the purpose of obtaining an electrostatic latent image, there is already known and commercially employed an electrophotographic process using a photosensitive device essentially consisting of a conductive layer, a photoconductive layer and a transparent insulating layer and comprising for example a primary charging step for subjecting the surface of the photosensitive device to a uniform charging of a predetermined polarity, an exposure step for exposing the surface to a light image, a secondary charging step for applying, simultaneously with the image exposure, an AC corona discharge or DC corona discharge of opposite polarity, and a whole surface exposure step.

One of such known photosensitive device is formed with an aluminium conductive layer, a selenium photoconductive layer and a polyethylene terephthalate (PET) as the insulating layer. Since the selenium based photoconductive layer is P-type, in the above mentioned primary charging step of the electrostatic latent image forming process, sufficient effect to form electric charge pairs across the insulating layer can not be obtained so that electrostatic latent image of sufficiently high electrostatic contrast can not be obtained.

Particularly, during the primary charging step, the dark resistance of the selenium photoconductive layer is high and the injection of carrier from the conductive layer side is low, with the result that the ideal state of forming electric charge pairs only across the insulating layer is not met. Consequently, the intensive charging step effect of the primary charging is decreased, and the contrast between the bright portion and the dark portion depends only on the simultaneous secondary charging and image exposure steps. When the secondary charging is performed by an AC corona charging element, nearly no contrast can be obtained, and when the secondary charging, is performed by a DC corona charging of opposite polarity, only very low contrast can be obtained.

To improve the contrast, an auxiliary method has been proposed wherein the secondary charging step is performed simultaneously with the image exposure steps after the primary charging step and simultaneous with whole surface exposure step or after the primary charging step and whole surface exposure step. While the contrast obtained by this method is improved, it is necessary to provide a whole surface exposure lamp for use in whole surface exposure step after the primary charging step, thereby complicating the apparatus. Further, it is still not possible as a practical matter to obtain sufficient contrast, and in a high speed process, such auxiliary method can not improve the problem.

To improve contrast, it has been proposed that a photoconductive layer formed by powdered material e.g. ZnO or CdS which is scattered in resin binder should be used in lieu of the selenium photoconductive layer. However such a photosensitive device creates problems of humidity durability.

SUMMARY OF THE INVENTION

The primary object of the present invention is to provide an electrophotographic photosensitive device exhibiting high humidity resistance and long life and which can obtain high electrostatic contrast, and a method of manufacture thereof.

Another object of the present invention is to provide an electrophotographic photosensitive device which can obtain a uniform and stable electrostatic latent image and a method of manufacture thereof.

A further object of the present invention is to provide a method of manufacturing a electrophotographic photosensitive device which makes it easy to form a conductive layer having an improved charge injection characteristic and intimate contact property.

To attain the above mentioned objects, the electrophotographic photosensitive device according to the present invention comprises an aluminium substrate conductive layer, a Zn conductive layer (or alternatively a Zn conductive layer and a Cu conductive layer), a Ni conductive layer, a Se based photoconductive layer and a transparent insulating layer which are sequentially laminated to one another.

The method of manufacturing electrophotographic photosensitive device, according to the present invention, comprises the steps of: forming a Zn conductive layer on a Al substrate conductive layer by substitution method or electroplating method, forming a Cu conductive layer and a Ni conductive layer or a Ni conductive layer on the Zn conductive layer by electroplating method, forming a Se based photoconductive layer on the Ni conductive layer by evaporation method, and forming a transparent insulating layer on the photoconductive layer.

By the above mentioned construction, according to the present invention, the charge injection characteristic during the primary charging step is improved and the charge injection preventing characteristic during the secondary charging and simultaneous image exposure steps is sufficiently maintained so that a high electrostatic contrast and a high humidity durable photosensitive device can be obtained. The Ni conductive layer contacts intimately with the Al substrate conductive layer so that electrostatic latent image obtained by the photosensitive device is uniform and stable.

The objects and advantages of the present invention are hereinafter set forth and explained with respect to the accompanying drawings.

DESCRIPTION OF PREFERRED EMBODIMENTS

Figure 1:
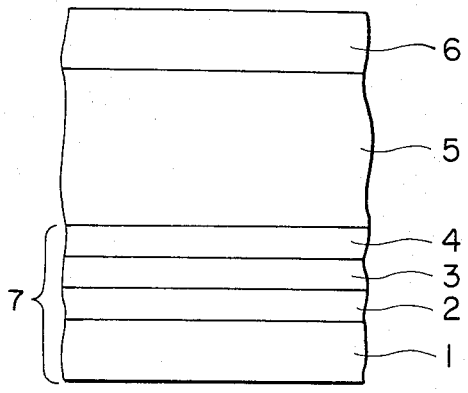
FIG. 1 and FIG. 2 are enlarged cross sectional views of portions of two embodiments of the electropotographic photosensitive device, according to the present invention.

Referring now to FIG. 1, the electrophotographic photosensitive device, according to the present invention is formed by: a conductive layer 7 including an Al substrate conductive layer 1; a Zn conductive layer 2; a Cu conductive layer 3; an Ni conductive layer 4; a Se based photoconductive layer 5; and a transparent insulating layer 6 which are sequentially laminated to one another.

The Al substrate conductive layer is known to be the most suitable conductive substrate for such photosensitive devices due to its machinability, hardness, cost and surface properties. For this reason, the photosensitive device according to the invention, also utilizes the Al substrate conductive layer 1.

If the Se based photoconductive layer 5 was directly formed on the Al substrate conductive layer, as in known devices, the charge injection characteristic from the Al conductive layer 1 to the photoconductive layer 5 during the primary charging operation is insufficient. To improve the problem, an Ni conductive layer 4 is inserted between the Al substrate and the Se based photoconductive layer. To attain the object, an Ni conductive layer could be coated directly on the Al substrate conductive layer. However, when Ni layer is formed on the Al layer by evaporation, the contact force between the layers is insufficient, and it is difficult to form the layer more than a few micro-meters in depth. When the Ni conductive layer 4 is directly coated on the Al substrate layer 1 by an electroplating method, it cannot be uniformly coated, the contact force between the layers is weak, the brightness is insufficient and the durability is reduced. Thus, according to the present invention, at least a Zn conductive layer 2 is inserted between the Ni conductive layer 4 and the Al substrate conductive layer 1. In the embodiment shown in FIG. 1, to adhere the Ni conductive layer 4 more intimately to the Zn conductive layer 2, a Cu conductive layer 3 is formed on the Zn conductive layer 2, and the Ni conductive layer 4 is formed on the Cu conductive layer 3.

In this case, the thickness of the inserted Zn conductive layer 2 is between 0.1–10 μm, preferably about 1 μm. The Zn layer may be formed by electroplating or may be formed by immersion in a substitution liquid. The thickness of the Cu conductive layer is between 1–50 μm, preferably about 10–15 μm. The Cu layer may be formed by electroplating utilizing CuCN solution.

The thickness of the Ni conductive layer, which is formed either directly on the Zn conductive layer 2 or on the intermediate Cu conductive layer 3, is between 0.5–50 μm, preferably about 5 μm. The Ni layer may be formed by electroplating. In this case, composition of the plating liquid is based on nickel sulfate which is added by small quantity of nickel chloride or ammonium chloride to improve electric conductivity. Boric acid is added to prevent pH changes. The solution maintains a pH of 2–6.5, at a temperature of 20°–70° C. and current density 0.5–50 A/dm$^2$ to form sufficient Ni conductive layer 4.

Thus plated, the Zn, Cu and Ni conductive layers form a conductive layer which is in intimate contact with the Al substrate conductive layer 1 and which permits sufficient charge injection to the photoconductive layer 5. It is believed that the reason for the improved intimate contact between the layers is the compatibility between adjacent materials at the interface of the conductive layers.

Also, the Zn, Cu and Ni conductive layers have uniform bright surfaces compared with Ni conductive layer surface directly formed on the Al substrate conductive layer. Further, the Zn, Cu and Ni conductive layers, according to the present invention are superior in cost, machinability, hardness and surface smoothness compared with a Ni conductive layer directly plated on the Al conductive layer and having a thickness equal to the total of the three layers 2, 3 and 4.

The transparent insulating layer 6 is formed on the photoconductive layer 5 by any suitable method to a thickness of about 5–40 μm. The insulating layer 6 is formed by a material which is transparent to visible rays and has high specific resistance e.g. more than $10^{14}\Omega\cdot$cm. Examples of such materials are polyethylene terephthalate, paraxyliren and acryl-, epoxi-, urethane-, fluor-, stylene- and carbonate-resin.

The photoconductive layer 5 is formed on the Ni conductive layer 4 by evaporation and consists of selenium only or selenium doped with Te, As, Ge, S, Sb or halogen.

Figure 2:
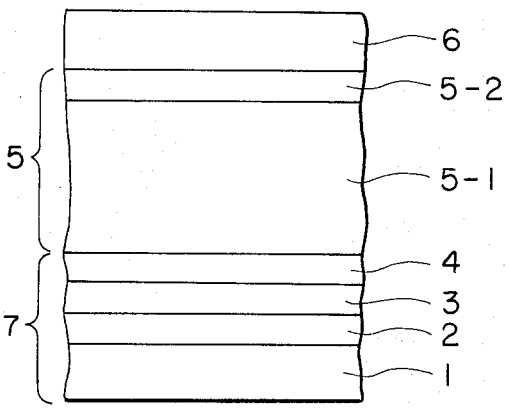

In the embodiment shown in FIG. 1, the selenium based photoconductive layer 5 is formed as single layer. In the embodiment shown in FIG. 2, the photoconductive layer 5 is formed by two layers, i.e. a selenium based charge transport layer 5-1 consisting of pure selenium or halogen doped selenium and a charge generating layer 5-2 based on Se and Te alloy. In FIG. 2, same reference numeral shows same or similar portion with that of FIG. 1.

As well known, to obtain high contrast in an electrostatic latent image, charge which is injected from the conductive layer 4 during the primary charging step should transport rapidly in the photoconductive layer without being blocked, to be captured sufficiently under the transparent insulating layer 6. In the process, the selenium based photoconductive layer decreases mobility when any impurity other than halogen is doped even to a small degree. For example, to contain tellurium as impurity is not desirable. On the other hand, when the photoconductive layer 5 is formed only by selenium, the photosensitive range of the photoconductive layer 5 is only within short wave range of visible rays during the simultaneous secondary charging and image exposure steps and the subsequent whole surface exposure step, so that photosensitive efficiency is low. To improve the photosensitive range and the overall efficiency of the device, the photoconductive layer 5 must be doped with tellurium or arsenic.

The embodiment shown in FIG. 2 comprises a two layered photoconductive layer 5 to satisfy both above mentioned requirements. More particularly, a charge generating layer 5-2, which mainly consists of selenium and tellurium, is formed below the layer 6 and is thin enough to prevent charge mobility from decreasing to increase the sensible wave length range and photosensibility of the device, so that efficiency during the simultaneous charging and image exposure steps and the subsequent whole surface exposure step is increased. Further, under the charge generating layer 5-2, a charge transport layer 5-1 which is formed. The layer 5-2 is formed by selenium only or halogen of 0–4000 ppm doped selenium and has a large charge mobility so that charges injected from the Ni conductive layer 4 during the primary charging step are easily transported. This makes it possible to increase the sensitivity during the primary charging operation.

The construction of the photoconductive layer 5 formed by the two layers is described in detail. The charge transport layer 5-1 consists of halogen doped selenium in which the halogen e.g. chlorine is 0–4000 ppm and the selenium is high purity more than 99.999%. The charge transport layer 5-1 is formed by vacuum evaporation process on the Ni conductive layer 4 to thickness about 20–70 μm. The charge generating layer 5-2 consists of selenium tellurium alloy in which tellurium content is 5-25%, and is formed by vacuum evaporation process on the charge transport layer 5-1 to thickness 0.05-5 μm. The selenium tellurium alloy may be doped by arsenic, silicon, antimony or halogen to prevent crystallization, to increase sensitivity and to remove residual charge.

When the vacuum evaporation process is performed, the temperature of the substrate layer 1 with the conductive layers 2-4 is set to 55°-65° C. When the vacuum evaporation temperature is below 55° C., residual potential is high, process response speed is low, and sufficient image contrast may not be obtained. When the vacuum evaporation temperature is more than 65° C., resistance of the photoconductive layer is substantially decreased so that charge injection and transport effect from the Ni conductive layer 4 are superior. However, charge injection and transport from the Ni conductive layer 4 are performed during the simultaneous secondary charging and image exposure steps without regard to the bright portion and the dark portion so that desired contrast of the image can not be obtained. Thus, the substrate temperature during the evaporation process should be set to between 55° and 65° C.

The embodiment shown in FIG. 2, in which the selenium based photoconductive layer 5 is formed in a two layered construction of the charge generating layer 5-2 and the charge transport layer 5-1, has been described in detail and the functions of the two layers to obtain the desired high contrast has been explained. The function of the Al, Zn, Cu and Ni conductive layer to obtain high image contrast will now be explained.

An important feature of the conductive layer is that it exhibits a sufficiently high charge injection during the primary charging step, and as low as possible a charge injection from the conductive layer side during the simultaneous secondary charging and image exposure steps to obtain desirable contrast between bright and dark portions. That is, material of the conductive layer must be matched with that of the photoconductive layer in accordance with the process carried out.

The Al, Zn, Cu and Ni conductive layer of the photosensitive device according to the present invention is compared with conventional Al conductive layer by the following experiments.

A conventional Se based photosensitive device having Al conductive layer and an Se based photosensitive device having Al, Zn, Cu and Ni conductive layers according to the present invention were prepared and subjected to corona charging of −2000 V in darkness and then to strong whole surface exposure. The potential drop was measured, and the value was about 1000 V in the conventional photosensitive device and was only about 250 V in the photosensitive device according to the present invention.

From this result it is clear that in the photosensitive device having Al, Zn, Cu and Ni conductive layers charge is injected from the conductive layer by charging of −2000 V in darkness and effective charge pairs corresponding to −1750 V is formed across the insulating layer 6 when the whole surface exposure step is started. In the conventional photosensitive device having Al conductive layer, potential of about −1000 V is distributed to the photoconductive layer which is about half of −2000 V charging in darkness, and charge pairs corresponding to −1000 V is formed across the insulating layer. This means that conventional Al conductive layer has a very poor charge injection characteristic compared with the conductive layers according to the invention.

Next, a secondary charging of +2000 V positive corona charging was applied to both photosensitive devices and potential change was measured. The measured potential change was about 1150 V in both device.

From the experiments described above, the photosensitive device according to the present invention proves superior charge injection characteristic during the primary charging step compared with conventional photosensitive devices, and has a charge injection preventing characteristic during the secondary charging step which is similar to that of conventional photosensitive devices, so that an electrostatic latent image of high contrast can be obtained.

In the photosensitive device, according to the present invention, physical property factors governing charge injection at the interface between the Al, Zn, Cu and Ni conductive layers and the Se based photoconductive layer can be considered as follows; the detailed physical reasons for these properties is, however, not clear.

(1) Physical and chemical surface conditions of the conductive layer.
(2) Density of recombination center of the Se based photoconductive layer at the interface.
(3) Barrier formability based on difference of work function between the Se based photoconductive layer and the conductive layer.
(4) Barrier formability based on difference of work functions between Al, Zn, Cu and Ni layers each other.

Method of manufacture of the above described electrophotographic photosensitive device, according to the present invention, will be described in detail by the following examples.

(I) EXAMPLE 1

An aluminium drum after being subjected to a fat removing treatment was dipped in alkali solution of NaOH: 525 g/l and ZnO: 100 g/l, for 1 minute to remove surface oxide skin, and a Zn layer of about thickness 1 μm was formed on the surface by a substitution process. On the surface of the Zn layer, a solution of CuCN: 41.3 g/l, NaCN: 48.8 g/l, $Na_2CO_3$: 30.0 g/l, Rochelle salt: 60.0 g/l, pH: 10.3, temperature: 40° C. was used to form Cu layer of thickness 10 μm by eletroplating (for 15 minutes). The reason for Cu plating is that, Ni plating directly on the Zn layer is unstable and insufficient contact is apt to occur.

The Cu plated drum was dipped in a solution of $NiSO_4$: 225 g/l, $NiCl_2$: 48 g/l, boric acid: 37.5 g/l, pH: 5, temperature: 57° C., and Ni was plated at current density 45 A/dm$^2$ for 20 min. to form an Ni layer having a thickness of about 10 μm on the Cu layer. The device was washed and dried, and heated to 60° C. An Se layer of 99.999% purity was vacuum evaporated to thickness of 50 μm on the Ni layer, and an Se Te alloy containing 10% Te was vacuum evaporatd to a thickness of 0.5 μm to form an Se based photoconductive layer. On the photoconductive layer, a PET film having a thickness of 20 μm was adhered to form the transparent insulating layer 6. Thus, a photosensitive device according to the preferred embodiment of the present invention, was contemplated.

The manufactured photosensitive device was charged to −2000 V by a scorotron charger during a primary charging step after which the simultaneous AC corona charging (6.5 KV) and image exposure steps and the whole surface exposure step were performed to obtain an electrostatic latent image.

The second sample of the device, after similar primary charging, was subjected to +6.5 KV DC positive corona charging and simultaneous image exposure steps, and whole surface exposure step to obtain electrostatic latent image.

The contrast potentials Vc obtained by the two methods are shown in AC and DC column of Table 1 and are 455 V and 565 V respectively. The electrostatic latent image was developed by magnetic brush method and copied on a paper. Superior copy image of high contrast was obtained.

Afterwards, charges were eliminated from the surface of the photosensitive device and the copy process was repeated. Residual potential and residual image did not appear and a superior image was obtained. Furthermore, the copy process was repeated, and contrast potential after 50000 cycles was about 90% compared with initial value, and proved a superior service life.

To inspect humidity durability, the photosensitive device was subjected in 85% relative humidity for three days and the above experiment was repeated. The contrast potential showed no essential change.

(II) EXAMPLE 2

An aluminium drum was subjected to a fat removing treatment, was then dipped in a zinc plating solution of ZnCN: 60 g/l, NaCN: 42 g/l, NaOH: 78.8 g/l, and a zinc layer of 2 m thickness was formed by electroplating. Then, as in Example 1, a Cu layer having a thickness of 5 μm and Ni layer having a thickness of 15 μm were sequentially plated to form a conductive layer comprising the Zn, Cu and Ni layers. Maintaining the conductive layer at temperature 57° C., selenium containing 15 ppm of chlorine was vacuum evaporated to a thickness of 45 μm on the conductive layer, then a selenium tellurium alloy containing 20% Te and 2% As was vacuum evaporated to a thickness of 1 μm to form the two layered photoconductive layer 5. On the photoconductive layer 5, paraxyliren-resin was evaporated to a thickness of 24 μm to form an insulating layer 6. Thus, a photosensitive device according to the invention was manufactured.

The photosensitive device was evaluated by similar conditions described in Example 1. The measured potentials are shown in the Table 1, and are sufficient to obtain a desired image. The humidity resistant characteristic and service life are also sufficient.

(III) EXAMPLE 3

An aluminium drum, after pretreatment including a fat removing process, was dipped in the zinc plating solution described in Example 2 to plate a Zn layer having a thickness of 2 μm on the surface of the drum and on the Zn layer, an Ni layer having a thickness of 15 μm was plated as described in Example 1. Then the conductive layer was heated to maintain a temperature of 57° C., and selenium containing 15 ppm chlorine was vacuum evaporated to a thickness of 45 μm. Further on the Se layer, Se an Te alloy containing 20% Te and 2% As was vacuum evaporated to a thickness of 1 μm to form a two layered photoconductive layer 5. On the photoconductive layer 5, a paraxyliren layer was vapor evaporated to a thickness of 24 μm to form the insulating layer 6. Thus, a photosensitive device according to preferred embodiment of the present invention was manufactured.

The photosensitive device was evaluated by the same condition described in Example 1. The measured contrast potentials are shown in the Table 1 and are sufficient to form a desired image. The humidity resistant characteristic is also superior. As to the service life measured after 50000 cycles, the values is practically serviceable and is better than the conventional device described in Reference 2 in Table 1.

(IV) Reference 1

On a pretreated aluminium drum, selenium having a purity of 99.999% was directly vacuum evaporated to a thickness of 50 μm and Se Te alloy containing 10% Te was vacuum evaporated to form the two layered photoconductive layer 5. On the photoconductive layer a transparent film of thickness 20 μm was adhered. Thus, a reference sample to evaluate the conductive layer was obtained. The photoconductive layer of two layered construction in Reference 1, is to eliminate the effect of the photoconductive layer.

The photosensitive device was evaluated as Example 1. The measured contrast potentials are shown in the Table 1, and are very low compared with those of Examples 1 and 2. The result indicates that the conductive layer comprising the Al, Zn, Cu and Ni layers according to the invention is superior compared with conventional Al conductive layer.

(V) EXAMPLE 4

On the conductive layer comprising the Al, Zn, Cu and Ni layers manufactured in a similar manner to Example 1, Se Te alloy containing 10% Te was vacuum evaporated to a thickness of 50 μm to form a photoconductive layer, on which a PET film having a thickness of 20 μm was adhered. Thus, a photosensitive device according to basic form of the present invention was manufactured.

The photosensitive device was evaluated by same condition described in Example 1. The measured contrast potentials are shown in Table 1, and are superior compared with the values of Reference 1. However, the values are less than those of Examples 1-3 which show the effect of two layered photoconductive layer.

(VI) Reference 2

On a pretreated aluminium drum, nickel was directly plated by the same process described in Example 1, without inserting the Zn and Cu layers, to thickness 10 μm. The photoconductive layer and the transparent insulating layer was formed as Example 1. The completed photosensitive device was evaluated as Example 1. The measured potentials are shown in Table 1. The contrast potentials are essentially similar to those of Examples 1 and 2. However, uniformity of image is not sufficient and some partial ununiformities can be recognized. As to the service life shown is Table 1, inferiority caused by contact characteristics between the layers can be seen.

TABLE 1

| | Contract potential (Vc) | | Vc value after |
|---|---|---|---|
| | AC charging | DC charging | 50.000 copies |
| Example 1 | 455 V | 565 V | 90% |
| Example 2 | 450 V | 570 V | — |
| Example 3 | 455 V | 575 V | 83% |
| Reference 1 | 70 V | 170 V | — |

TABLE 1-continued

| | Contract potential (Vc) | | Vc value after |
|---|---|---|---|
| | AC charging | DC charging | 50,000 copies |
| Example 4 | 350 V | 400 V | — |
| Reference 2 | 450 V | 570 V | 75% |

It will be appreciated that the photosensitive device according to the present invention comprises an Ni conductive layer as an interface conductive layer with the selenium based photoconductive layer, and has an improved charge injection characteristic during the primary charging step and also maintains the charge injection preventing characteristic during the simultaneous secondary charging and image exposure steps so that high contrast and high concentration copy image can be obtained.

The interface conductive layer of nickel intimately contacts with the Al substrate conductive layer through the inserted Zn conductive layer or the Cu conductive layer formed on the Zn conductive layer so that uniformity and stability of the electrostatic latent image are superior and that contrast potential does not decrease substantially by repeated copy cycles so that the device has a long life.

The photosensitive device having the selenium based photoconductive layer which is formed by the charge generating layer and the charge transport layer, according to the preferred embodiment of the present invention, causes generation of carrier charges by light exposure to be allotted to the charge generating layer and the transport of generated carrier charges and transport of injected carrier charges to be allotted to the charge transport layer, with the result that the photosensitivity of the device is superior and image characteristic of the device is superior without a residual potential and residual image. Also, since the photoconductive layer is formed by selenium based evaporated film, it has a very high humidity resistant property compared with a conventional binder based photoconductive layer.

It is clear that the method of manufacturing photosensitive device, according to the present invention, makes it possible to easily manufacture a high quality electrophotographic photosensitive device having intimately contacted conductive layers.

In the above described embodiments, the image forming process of the photosensitive device includes simultaneous charging and image exposure steps. However, the photosensitive device, according to the present invention is not limited to such an image forming process. For example, an image forming process including negative corona charging as a primary charging step and simultaneous whole surface exposure step, positive corona charging step and image exposure step can be applied to the photosensitive device, according to the present invention. Also, the image forming process includes primary charging step and simultaneous whole surface exposure step, however, as the photosensitive device, according to the present invention has superior charge injection characteristic, sufficient charge pairs can be formed across the transparent insulating layer without applying the whole surface exposure step.

What is claimed is:

1. An electrophotographic photosensitive device, comprising:

an aluminium substrate conductive layer;

a zinc conductive layer formed on the aluminium conductive layer;

a nickel conductive layer formed on the zinc conductive layer;

a selenium based photoconductive layer formed on the nickel conductive layer; and a transparent insulating layer formed on the photoconductive layer.

2. An electrophotographic phootosensitive device, comprising:

an aluminium substrate conductive layer;

a zinc conductive layer formed on the aluminium conductive layer;

a copper conductive layer formed on the zinc conductive layer;

a nickel conductive layer formed on the copper conductive layer;

a selenium based photoconductive layer formed on the nickel conductive layer; and a transparent insulating layer formed on the photoconductive layer.

3. A photosensitive device according to claim 1, in which said selenium based photoconductive layer consists of a charge transport layer formed on said nickel conductive layer and formed of selenium or halogen doped selenium; and a charge generating layer formed on said charge transport layer and formed of a selenium and tellurium based alloy.

4. A photosensitive device according to claim 2, in which said selenium based photoconductive layer consists of:

a charge transport layer formed on said nickel conductive layer and formed of selenium or halogen doped selenium; and a charge generating layer formed on said charge transport layer and formed of selenium and tellurium based alloy.

5. A photosensitive device according to claim 3, in which said charge transport layer consists of selenium evaporated layer containing 0–4000 ppm halogen and having a thickness of 25–70 μm, and said charge generating layer consist of a selenium tellurium alloy evaporated layer containing 5–25% tellurium and having a thickness of 0.05–5 μm.

6. A photosensitive device according to claim 4, in which said charge transport layer consists of selenium evaporated layer containing 0–4000 ppm halogen and having a thickness of 25–70 μm, and said charge generating layer consist of a selenium tellurium alloy evaporated layer containing 5–25% tellurium and having a thickness of 0.05–5 μm.

7. A method of manufacturing an eletrophotographic photosensitive device, comprising steps of:

forming a zinc conductive layer on an aluminium substrate conductive layer by substitution method or electroplating method;

forming a nickel conductive layer on the zinc conductive layer by electroplating method;

forming a selenium based photoconductive layer on the nickel conductive layer by evaporation method; and forming a transparent insulating layer on the photoconductive layer.

8. A method of manufacturing an electrophotographic photosensitive device, comprising steps of:

forming a zinc conductive layer on an aluminium substrate conductive layer by substitution method or electroplating method;

forming a copper conductive layer on the zinc conductive layer by electroplating method;

forming a nickel conductive layer on the copper conductive layer by electroplating method;

forming a selenium based photoconductive layer on the nickel conductive layer by evaporation method; and forming a transparent insulating layer on the photoconductive layer.

9. A method according to claim 7, in which said selenium based photoconductive layer is formed by evaporation on said nickel conductive layer which is kept to a temperature of between 55°–65° C.

10. A method according to claim 8, in which said selenium based photoconductive layer is formed by evaporation on said nickel conductive layer which is kept to a temperature of between 55°–65° C.

* * * * *

UNITED STATES PATENT AND TRADEMARK OFFICE

CERTIFICATE OF CORRECTION

PATENT NO. : 4,537,845

DATED : August 27, 1985

INVENTOR(S) : Yoshiyuki Mimura et al.

It is certified that error appears in the above-identified patent and that said Letters Patent is hereby corrected as shown below:

The term of this patent subsequent to August 27, 2002 has been disclaimed.

Signed and Sealed this

*Twelfth* Day of *November 1985*

[SEAL]

*Attest:*

DONALD J. QUIGG

*Attesting Officer*

*Commissioner of Patents and Trademarks*